United States Patent [19]

Tsuchida

[11] Patent Number: 4,592,314

[45] Date of Patent: Jun. 3, 1986

[54] VALVE ACTUATING MECHANISM FOR INTERNAL COMBUSTION ENGINE

[75] Inventor: Naoki Tsuchida, Iwata, Japan

[73] Assignee: Yamaha Hatsudoki Kabushiki Kaisha, Japan

[21] Appl. No.: 724,603

[22] Filed: Apr. 18, 1985

[51] Int. Cl.[4] ..... F01M 9/10

[52] U.S. Cl. ..... 123/90.36; 123/90.27; 123/90.4; 123/90.44

[58] Field of Search ..... 123/90.36, 90.39, 90.4, 123/90.44, 90.27

[56] References Cited

U.S. PATENT DOCUMENTS

| | | | |
|---|---|---|---|
| 1,415,167 | 5/1922 | Fuchs | 123/90.27 |
| 1,936,653 | 11/1933 | Almen | 123/90.36 |
| 2,385,309 | 9/1945 | Spencer | 123/90.36 |
| 3,400,696 | 9/1968 | Thompson | 123/90.44 |
| 3,722,484 | 3/1973 | Gordini | 123/90.27 |
| 3,855,981 | 12/1974 | Loon | 123/90.44 |
| 3,875,908 | 4/1975 | Ayres | 123/90.44 |

FOREIGN PATENT DOCUMENTS

| | | | |
|---|---|---|---|
| 84685 | 11/1920 | Austria | 123/90.44 |
| 186010 | 11/1982 | Japan | 123/90.27 |
| 296125 | 8/1928 | United Kingdom | 123/90.27 |

*Primary Examiner*—Ira S. Lazarus

*Attorney, Agent, or Firm*—Ernest A. Beutler

[57] ABSTRACT

An improved lubricating and valve actuating system for an internal combustion engine having plural valves per combustion chamber. Two valves are operated by the same camshaft, one directly and the other through a rocker arm. A lubricating system is provided that includes a passage that extends through the rocker arm pivotal axis and the sliding support for the thimble tappet of the directly actuated valve for lubricating both actuating mechanisms.

15 Claims, 5 Drawing Figures

VALVE ACTUATING MECHANISM FOR INTERNAL COMBUSTION ENGINE

BACKGROUND OF THE INVENTION

This invention relates to a valve actuating mechanism for internal combustion engines and more particularly to an improved arrangement for actuating plural valves for a given combustion chamber and for lubricating the actuating mechanism.

It is well known that the specific output of an internal combustion engine may generally be improved by employing plural valves for each combustion chamber. By using two or more intake and/or exhaust valves, it is possible to obtain a greater flow area for a given surface area and higher rotating speeds due to reduced inertia. Certain practical limitations, however, have limited the use of such plural valve applications. Among the main of these limiting factors is the geometric relationship of the combustion chamber and the associated actuating mechanism. That is, if plural valves are employed, an arrangement should be provided so as to insure that the valves will not interfere with each other during their opening and closing operation and, at the same time, the ratio of the surface volume of the combustion chamber to its clearance volume should be kept relatively small. In addition, the clearance volume itself should be maintained as small as possible so as to permit the use of high compression ratios. These factors have practically limited the valving arrangements of internal combustion engines to two intake and/or exhaust valves per cylinder.

Recently, it has been proposed to provide a valve actuating mechanism and valve placement that will permit the use of three or more intake and/or exhaust valves for a single combustion chamber. One way this can be done is by employing a single camshaft that operates the three or more valves with the operation of one of the valves being done directly through a tappet follower and the operation of other of the valves being done through rocker arms. A very practical arrangement for achieving this purpose is shown in the copending application entitled "Actuating Mechanism For Multiple Valve Internal Combustion Engine, filed in my name along with Kazuo Aoi as a joint inventor, Ser. No. 717,832, Filed 3/29/85, and assigned to the assignee of this application. As described in that copending application, the desired valve placement may be achieved and a compact actuating mechanism employed by operating one valve directly through a thimble tappet and the other two valves by means of rocker arms, all from the same camshaft. Although this arrangement has many advantages, it is necessary to provide good lubrication for all of the valve actuating components.

It is, therefore, a principal object of this invention to provide an improved actuating mechanism for multiple valve internal combustion engines.

It is a yet further object of this invention to provide an improved multiple valve actuating mechanism and a lubricating system for it.

It is a yet further object of this invention to provide an improved and simplified lubricating arrangement for the actuating mechanism for a multiple valve internal combustion engine.

SUMMARY OF THE INVENTION

This invention is adapted to be embodied in a valve train for an internal combustion engine having a cylinder head assembly, a first poppet valve supported by the cylinder head assembly for reciprocation along an axis defined by its stem and a second poppet valve supported by the cylinder head assembly for reciprocation along an axis defined by its stem. A camshaft is supported by the cylinder head assembly for rotation about a rotational axis that is intersected by the first poppet valve stem axis. Cam means are provided on the camshaft and a tappet is slidably supported by the cylinder head assembly and is associated with the cam means and the first valve for opening directly the first valve. A rocker arm is supported for pivotal movement and is associated with the cam means for pivoting the rocker arm. Means on the rocker arm are operative to actuate the second valve upon pivotal movement of the rocker arm. The second rocker arm is pivotally supported by a rocker arm shaft that is carried by the cylinder head assembly. Lubricant passage means extend through the cylinder head assembly and through the rocker arm shaft for lubricating the pivotal support for the rocker arm and the sliding support for the tappet.

DETAILED DESCRIPTION OF THE PREFERRED EMBODIMENT

Figure 1:
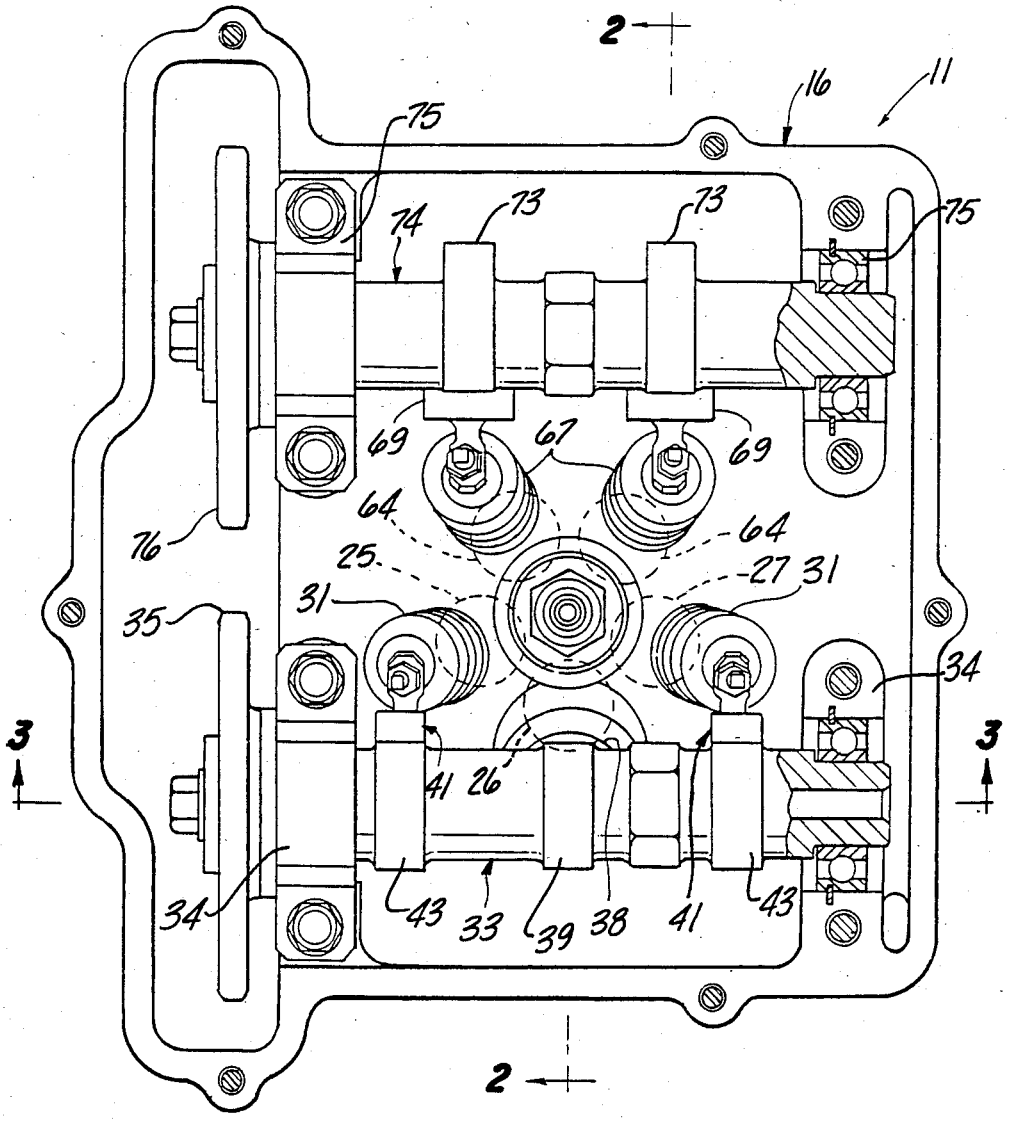
FIG. 1 is a top plan view of a cylinder head of an internal combustion engine constructed in accordance with an embodiment of the invention, with the cam cover removed and portions broken away.

In the drawings, the reference numeral 11 illustrates an internal combustion engine constructed in accordance with an embodiment of the invention. In the illustrated embodiment, the engine 11 is of the single cylinder type. It is to be understood, however, that the invention may be practiced in conjunction with multiple cylinder engines and engines having varying cylinder configurations such as inline, V type, opposed, etc. The application of the principle of the invention to such cylinder configurations is believed to be obvious to those skilled in the art in view of the following description.

The engine 11 includes a cylinder block assembly 12 having a cylinder bore 13 in which a piston 14 is supported for reciprocation. The piston 14 is connected to a connecting rod 15 which, in turn, drives a crankshaft (not shown) in a known manner. Since the invention is directed primarily toward the valve actuating mechanism for the engine 11 and its lubrication, the other portions of the engine have not been illustrated and will not be described in any great detail.

Figure 3:
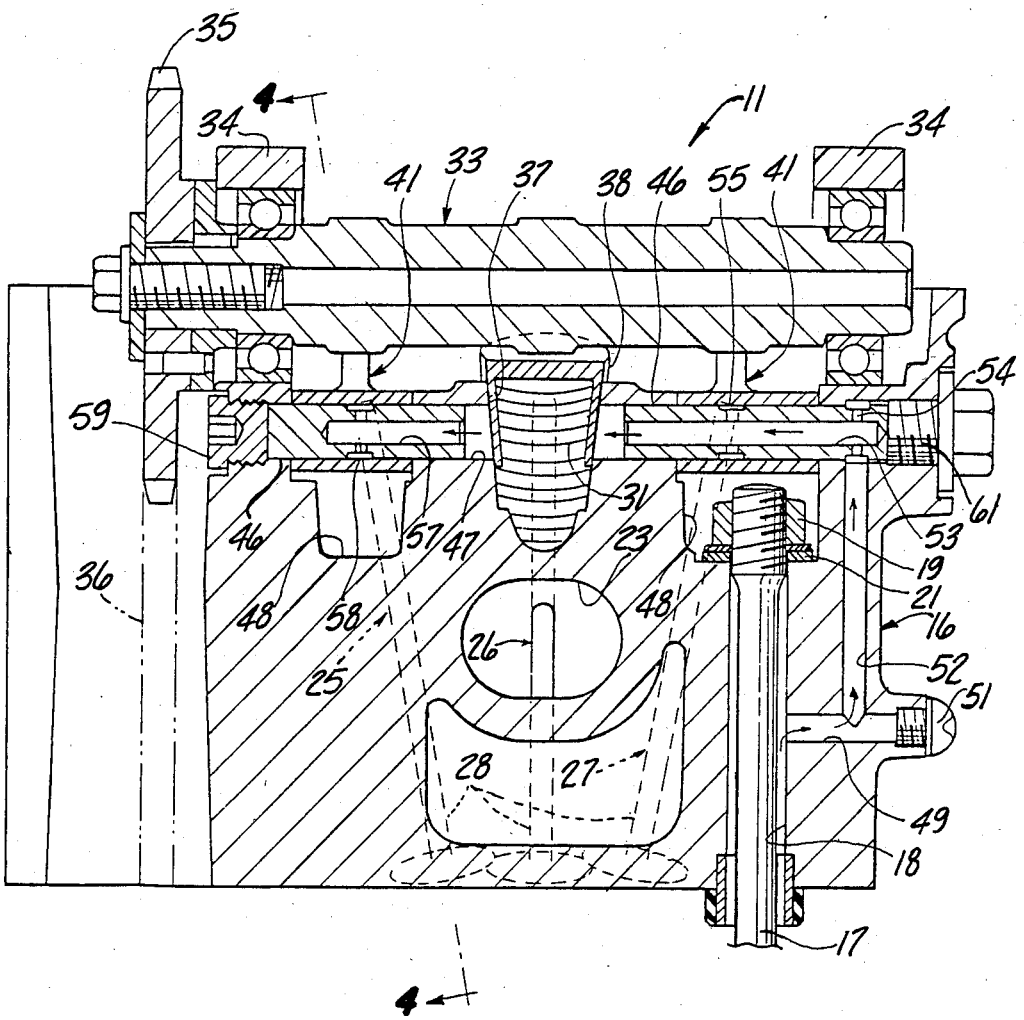
FIG. 3 is a cross-sectional view taken along the line 3—3 of FIG. 1.

A cylinder head assembly, indicated generally by the reference numeral 16, is affixed to the cylinder block 12 by means including a plurality of studs 17 that are threaded into the cylinder block assembly 12 (FIG. 3). The studs 17 pass through apertures 18 formed in the cylinder head assembly 16 and the cylinder head assembly 16 is clamped in place by means of nuts 19 and washers 21.

The cylinder head assembly 16 and specifically its lower face is provided with a recess 22 that cooperates with the head of the piston 14 and the cylinder bore 13 to provide a chamber which varies in volume during the reciprocation of the piston 14. This chamber will at times be referred to as the combustion chamber.

An induction system comprised of one or more intake passages 23 is formed in one side of the cylinder head assembly 16. The intake passages 23 open at their outer ends through a face 24 of the cylinder head assembly 16 and a suitable induction system consisting of an intake manifold and/or carburetors or a fuel injection system mates with the face 24 so as to deliver a fuel/air charge to the intake passages 23. The intake passages 23 terminate at their outlet ends in intake ports defined by intake valve seats at the cavity 22. If a single intake passage 23 is formed in the cylinder head, it will branch into three intake ports or one per intake valve, as will be described. Alternatively, if separate passages are employed, they may terminate in individual valve seats or themselves divide into passages that serve individual valve seats. The configuration of the intake passages 23 forms no part of the invention and, for that reason, it has not and will not be described in any further detail. The important feature is that there are a plurality of intake valve seats and/or ports and, in the illustrated embodiment, there are three of such intake valve seats. It is to be understood, however, that the invention is susceptible of use with other, plural intake and/or exhaust valve arrangement.

The flow through the respective valve seats is controlled by intake valves, indicated generally by the reference numerals 25, 26, and 27. The intake valves 25, 26 and 27 all have valve stems 28 that are slidably supported in valve guides 29 pressed into the cylinder head assembly 16. The axes of reciprocation of the various intake valves 25, 26 and 27 are oriented in a particular manner as described in the aforenoted copending patent application in which I am a coinventor with Kasuo Aoi. In view of the description of the orientation in that copending application, it will not be repeated here. However, in summary, it should be noted that the intake valve 26 has its axis of reciprocation disposed at a lesser angle to the axis of the cylinder bore 13 than that of the intake valves 25 and 27 in a plane parallel to the plane of FIG. 2. In this plane, the intake valves 25 and 27 have their axes of reciprocation at the same angle to the axis of the cylinder bore 13. The axes of reciprocation of the intake valves 25 and 27, however, intersect a perpendicular plane as shown in FIG. 3.

Coil compression springs 31 encircle the upper ends of each of the valve stems 28 and act against the cylinder head assembly 16 and keepers 32 affixed to the respective valve stems 28 for urging the intake valves 25, 26 and 27 to their closed positions where they engage the respective valve seats and preclude flow from the intake passages 23 into the chamber 22.

An intake camshaft, indicated generally by the reference numeral 33, is journaled by the cylinder head assembly 16 by means of spaced bearings and bearing cap assemblies 34. The axis of rotation of the intake camshaft 33 is intersected by the reciprocal axis of the intake valve 26. The axes of reciprocation of the valves 25 and 27 do not, however, intersect the axis of rotation of the intake camshaft 33 since, as aforenoted, these valves reciprocate along axes that are not parallel to the axis of the intake valve 26. A sprocket 35 is affixed to the forward end of the camshaft 33 and is driven by means of a timing chain 36 which is, in turn, driven by the engine crankshaft in a known manner.

Figure 2:
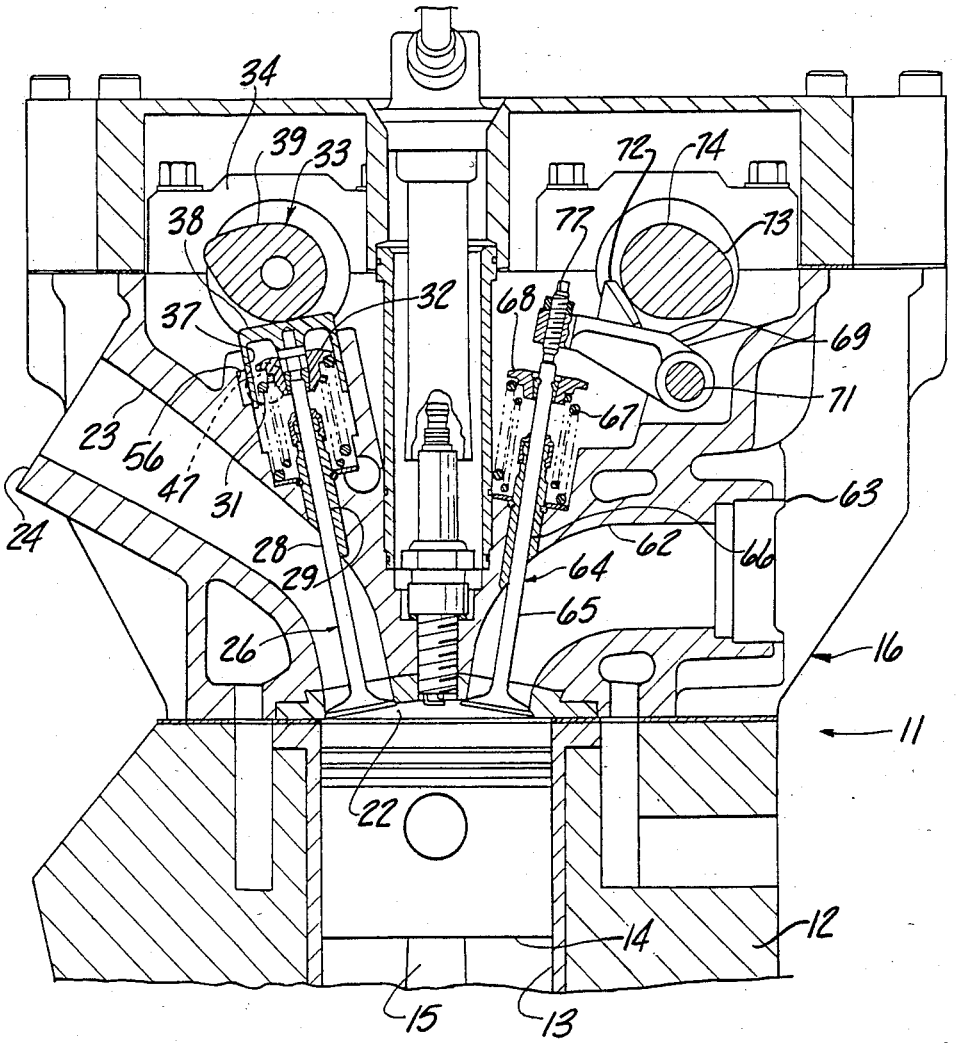
FIG. 2 is a cross-sectional view taken along the line 2—2 of FIG. 1.
Figure 5:
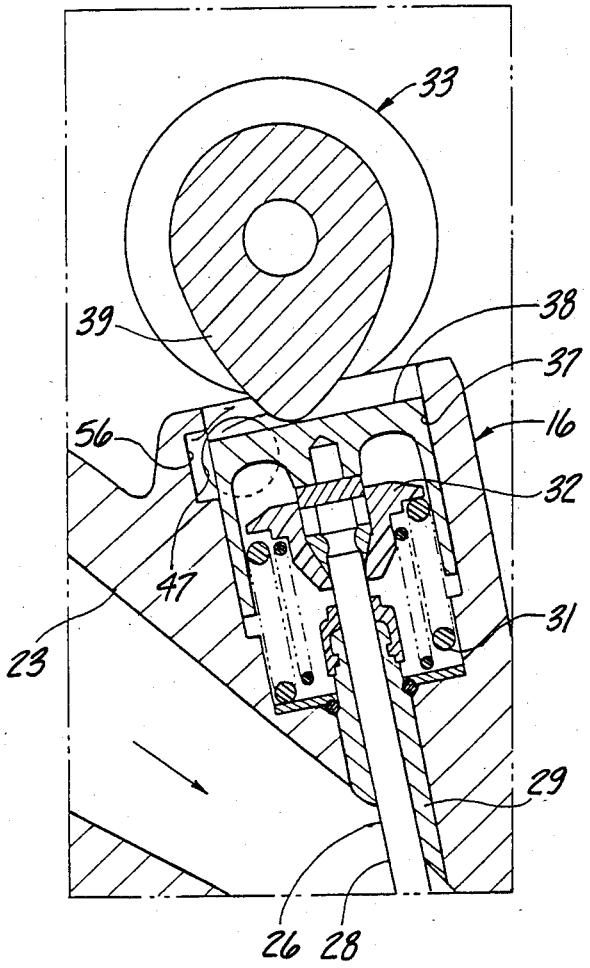
FIG. 5 is an enlarged cross-sectional view taken through the center of the cam lobe that actuates the directly operated valve.

Referring primarily to FIGS. 2 and 5, the cylinder head assembly 16 is provided with a counterbored opening 37 that is aligned with the axis of reciprocation of the stem 28 of the intake valve 26. A thimble tappet 38 is slidably supported within this counterbore 37 and is engaged with the tip of the stem 28 of the intake valve 26 for direct actuation of the intake valve 26. The thimble tappet 38 is actuated by a cam lobe 39 that is formed on the camshaft 33.

Figure 4:
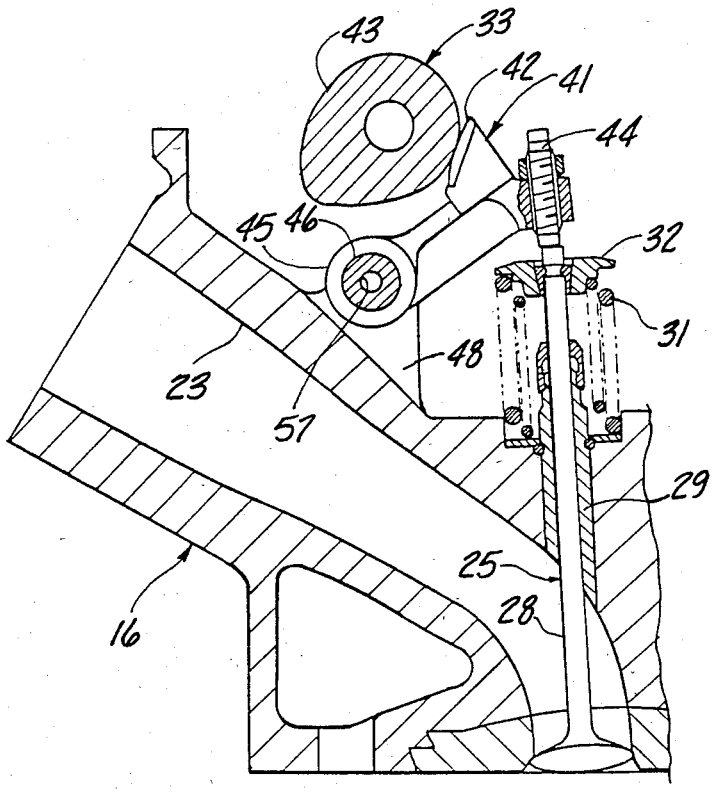
FIG. 4 is a cross-sectional view taken along the line 4—4 of FIG. 1.

While the intake valve 26 is operated directly from the cam lobe 39 by the thimble tappet 38, the intake valves 25 and 27 are indirectly actuated by means of respective rocker arm assemblies, indicated generally by the reference numeral 41. Since the rocker arm assemblies 41 are identical in construction, only one of them will be described in particular detail by reference primarily to FIG. 4. The rocker arm assembly 41 has a follower portion 42 that is engaged with a respective cam lobe 43 formed on the cam shaft 33. The cam lobes 43 are spaced apart on opposite sides of the cam lobe 39. Adjusting screws 44 are carried at the outer ends of the rocker arms 41 and are engaged with the tips of the stems 28 of the respective intake valves 25 and 27 for actuating the intake valves 25 and 27 upon pivotal movement of the rocker arms 41.

The rocker arms 41 have bearing sections 45 that are formed within internal bores that are slidably supported on respective rocker arm shafts 46 that are carried within an elongated bore 47 formed in the cylinder head assembly 16. It should be noted that the rocker arm shafts 46 are stub shafts and are spaced from each other on opposite sides of the thimble tappet 38 as best seen in FIG. 3.

The bore 47 extends linearly through the cylinder head assembly 16 and is interrupted by recesses 48 that form clearances for the rocker arm shaft bearing portions 45 and which have machined surfaces for axially fixing the location of the rocker arms 41. Also, it should be noted that the bore 47 intersects the counterbore 37 in which the tappet 38 reciprocates, for a reason now to be described.

A lubricating system is provided for lubricating the valves and valve actuating mechanims. This lubricating system includes a pressure inlet line that extends through one of the cylinder head bores 18 that pass the fastening studs 17 (FIG. 3). A cross-drilled passageway 49 is formed in the adjacent side of the cylinder head assembly 16 and its outer end is closed by a screw 51. The cross-drilled passageway 49 is intersected by a vertically extending drilled passageway 52 that extends through the cylinder head 16 and which intersects the bore 47. The rocker arm shaft 46 associated with the rocker arm 41 of the intake valve 27 is provided with a through bore 53 that receives oil from the passageway 52 through one of more cross-drillings 54 and appropriate reliefs. Hence, oil from the counterbore 18 and passageways 49 and 52 is delivered to the interior of this rocker arm shaft 46 through the passageways 54 so that the hollow interior 53 of this rocker arm shaft is pressurized.

Oil under pressure is delivered from the passageway 53 to the bearing for the rocker arm 41 associated with the intake valve 27 by means of delivery passageways 55 formed in the rocker arm shaft 46 associated with this rocker arm.

As has been previously noted, the drilled passage 47 intersects the counterbore 37 in which the thimble tappet 38 is slidably supported. This relationship is best shown in FIG. 5. In this area, the counterbore 37 is formed with an oil delivery relief passage 56 that extends vertically upwardly and which has a restricted configuration. Lubricant will be delivered to the exterior of the thimble tappet 38 and the counterbore 37 for lubricating the sliding surfaces through the passageway 47. In addition, at the time the intake valve 26 is fully opened when the cam lobe 39 has fully depressed the thimble tappet 38, the upper end of the passageway 56 will be opened so that lubricant may flow directly into the head of the thimble tappet 38 so as to lubricate it and the cam lobe 39. This communication is provided only at such times as the intake valve 26 is nearly at or in its fully opened position so that there will not be a continuous flow of lubricant out of this opening.

Referring now again to FIGS. 3 and 4, the passageway 47 extends past the thimble tappet supporting bore 37 and delivers lubricant to a drilled opening 57 that is formed in the rocker arm shaft 46 associated with the rocker arm 41 of the intake valve 25. This passage 57 does not extend completely through the rocker arm shaft 46 as clearly shown in FIG. 3. The lubricant that is delivered to the opening 57 is discharged through delivery passages 58 cross-drilled in the rocker arm shaft 46 so as to lubricate the bearing portions of the rocker arm 41 associated with the intake valve 25.

The rocker arm shaft 46 associated with the intake valve 25 is held in place and the outer end of the bore 47 is closed by means of a plug 59. In a similar manner, the opposite end of the cross-drilled passage 47 is closed by a plug 61 that is screwed into the cylinder head.

On the side of the cylinder head assembly 16 opposite to that in which the intake passages 23 are formed, there are formed exhaust passages 62. As with the intake passages 23, there may be one or more such exhaust passages 62 and they terminate in a plurality of exhaust valve seats that communicate with the chamber 22. The opposite ends of the exhaust passages 62 open through a side face 63 of the cylinder head assembly 16 for connection to an appropriate exhaust manifold (not shown). In the illustrated embodiment, there are two such exhaust passages 62 and exhaust valve seats. Exhaust valves, indicated generally by the reference numeral 64 of the poppet type, are provided with stems 65 that are slidably supported in valve guides 66 pressed into the cylinder head assembly 16. The heads of the poppet valves 64 control the flow through the exhaust valve seats to the exhaust passages 62.

Coil compression springs 67 encircle the upper ends of the stems 65 of the exhaust valves 64. The springs 67 react against the cylinder head 16 and valve keepers 68 that are affixed to the upper ends of the stems 65 for urging the exhaust valves 64 to their closed positions.

The exhaust valves 64 are each operated indirectly by means of exhaust rocker arms 69 that are rotatably journaled on an exhaust rocker arm shaft 71 that is affixed in an appropriate manner to the cylinder head assembly 16. The exhaust rocker arms 69 have follower portions 72 that are engaged with lobes 73 of an exhaust camshaft 74. The exhaust camshaft 74 is supported for rotation on the cylinder head assembly 16 by bearing assemblies and bearing caps 75. A sprocket 76 is affixed to the forward end of the exhaust camshaft 74 and is driven in timed relationship with the intake camshaft 33 and crankshaft by the timing chain 36.

Adjusting screws 77 are carried at the outer ends of the exhaust rocker arms 69 and engage the tips of the stems 65 of the exhaust valves 64 for operating these exhaust valves. Although an arrangement is provided wherein there are two exhaust valves 64 and they are operated by rocker followers 69, it should be understood that three or more exhaust valves could be employed having an actuating and lubricating system as associated with the intake valves 25, 26 and 27. In addition, it should be readily apparent that the arrangement for actuating the lubricating the actuating mechanism for the intake valves provides a very compact and yet highly effective system.

Although an embodiment of the invention has been illustrated and described, it should be readily apparent that various changes and modifications may be made, without departing from the spirit and scope of the invention, as defined by the appended claims.

I claim:

1. In a valve train for an internal combustion engine having a cylinder head assembly, a first poppet valve supported by said cylinder head assembly for reciprocation along an axis defined by its stem, a second poppet valve supported by said cylinder head assembly for reciprocation along an axis defined by its stem, a camshaft supported by said cylinder head assembly for rotation about a rotational axis intersected by said first poppet valve stem axis, cam means on said camshaft, a tappet slidably supported by said cylinder head assembly and associated with said cam means and said first valve for opening directly said first valve, a rocker arm supported for pivotal movement and associated with said cam means for pivoting said rocker arm, and means on said rocker arm operative to actuate said second valve upon pivotal movement of said rocker arm, the improvement comprising said rocker arm being pivotally supported by a rocker arm shaft carried by said cylinder head assembly and lubricant passage means extending through said cylinder head assembly and through said rocker arm shaft for lubricating the pivotal support for said rocker arm and the sliding support for said tappet.

2. In a valve train as set forth in claim 1 wherein the lubricant passage means comprises an aligned passage extending through the rocker arm shaft and intersecting the area of slidable support of the tappet.

3. In a valve train as set forth in claim 2 wherein the passage means includes a portion adapted to be exposed upon movement of the tappet to its fully depressed position for lubricating the head of the tappet and the cam means.

4. In a valve train as set forth in claim 2 wherein the first and second valves control the flow through ports that serve the same function for the engine.

5. In a valve train as set forth in claim 1 further including a third poppet valve supported by the cylinder head assembly for reciprocation along an axis defined by its stem and a second rocker arm cooperating with said cam means for actuating said third valve, said second rocker arm being supported for pivotal movement by a second rocker arm shaft carried by said cylinder head assembly, said passage means extending through said second rocker arm shaft for lubricating the pivotal support for said second rocker arm.

6. In a valve train as set forth in claim 5 wherein the lubricant passage means comprises an aligned passage extending through the rocker arm shaft and intersecting the area of slidable support of the tappet.

7. In a valve train as set forth in claim 6 wherein the passage means includes a portion adapted to be exposed upon movement of the tappet to its fully depressed position for lubricating the head of the tappet and the cam means.

8. In a valve train as set forth in claim 5 wherein the valves all serve the same function.

9. In a valve train as set forth in claim 8 wherein the valves are all angularly disposed to each other.

10. In a valve train as set forth in claim 8 wherein the valves are not parallel.

11. In a valve train as set forth in claim 8 wherein the axis of the first and third valves are at the same angle to a plane containing the axis of an associated cylinder bore, which angle is less than the angle of the second valve axis to the same plane.

12. In a valve train as set forth in claim 1 further including means for delivering lubricant to the passage means through a bore in the cylinder head passing a stud for affixing the cylinder head to a cylinder block.

13. In a valve train as set forth in claim 5 further including means for delivering lubricant to the passage means through a bore in the cylinder head passing a stud for affixing the cylinder head to a cylinder block.

14. In a valve train as set forth in claim 13 wherein the lubricant passage means comprises an aligned passage extending through the rocker arm shaft and intersecting the area of slidable support of the tappet.

15. In a valve train as set forth in claim 14 wherein the passage means includes a portion adapted to be exposed upon movement of the tappet to its fully depressed position for lubricating the head of the tappet and the cam means.

* * * * *